US007632996B2

(12) United States Patent
Inouye

(10) Patent No.: US 7,632,996 B2
(45) Date of Patent: Dec. 15, 2009

(54) PIANO HAMMER

(76) Inventor: Asami Inouye, 180 Riverside Blvd., New York, NY (US) 10069

( * ) Notice: Subject to any disclaimer, the term of this patent is extended or adjusted under 35 U.S.C. 154(b) by 0 days.

(21) Appl. No.: 12/043,586

(22) Filed: Mar. 6, 2008

(65) Prior Publication Data

US 2009/0223343 A1 Sep. 10, 2009

(51) Int. Cl.
*G10C 3/18* (2006.01)

(52) U.S. Cl. ..... 84/254

(58) Field of Classification Search ..... 84/254
See application file for complete search history.

(56) References Cited

U.S. PATENT DOCUMENTS

| | | | | |
|---|---|---|---|---|
| 888,141 | A * | 5/1908 | Dodge | 84/254 |
| 3,487,429 | A * | 12/1969 | Johnson | 84/254 |
| 3,805,662 | A * | 4/1974 | Nishimura et al. | 84/254 |
| 3,878,752 | A * | 4/1975 | Yamada | 84/254 |
| 4,007,835 | A * | 2/1977 | Klothe | 206/411 |
| 4,135,430 | A | 1/1979 | Hayashida | |
| 4,490,427 | A * | 12/1984 | Grant et al. | 428/107 |
| 4,706,540 | A * | 11/1987 | Donohoe | 84/414 |
| 4,906,507 | A * | 3/1990 | Grynaeus et al. | 428/113 |
| 5,125,310 | A | 6/1992 | Lombino | |
| 5,811,702 | A * | 9/1998 | Tomizawa et al. | 84/254 |
| 6,838,605 | B2 * | 1/2005 | Belli | 84/411 R |
| 7,056,552 | B2 * | 6/2006 | Kugo et al. | 427/208.2 |
| 7,109,134 | B2 * | 9/2006 | South | 442/150 |
| 7,262,351 | B2 * | 8/2007 | Inouye | 84/254 |
| 2005/0235803 | A1 * | 10/2005 | Inouye | 84/236 |
| 2005/0235807 | A1 * | 10/2005 | Kraus | 84/385 P |
| 2008/0124513 | A1 * | 5/2008 | Eleazer et al. | 428/113 |
| 2008/0189830 | A1 * | 8/2008 | Egglesfield | 2/244 |

OTHER PUBLICATIONS

About Pellon Consumer Products, History of the Pellon © brand and a citation of the fusible products available, viewed originally on Mar. 13, 2007 at www.pelonideas.com/content/view/12/26/.*

Hot melt adhesive, detailing the hot glue gun and thermoplastic glue, page last modified Feb. 19, 2009, viewed Feb. 25, 2009 at en.wikipedia.org/wiki/Glue_gun.*

(Continued)

*Primary Examiner*—Jeffrey Donels
*Assistant Examiner*—Robert W Horn
(74) *Attorney, Agent, or Firm*—Martin Fleit; Paul D. Bianco; Fleit Gibbons Gutman Bongini & Bianco PL

(57) ABSTRACT

A piano hammer comprises an elongate hammerhead having a nose portion defining side surfaces and a felt covering extending about the nose portion with tail portions of the felt covering affixed to the side surfaces. The felt covering defines a substantially elliptical peripheral surface from a top region for striking a piano string to front and back regions. An elongated single or dual layer strip is arranged on the peripheral surface of the felt covering in the top region, extending along the front and back regions to points beyond the hammer equator. The layers of this strip or "voicing tape" are made of a synthetic non-woven fabric material, preferably of the type sold under the registered trademark Pellon.

12 Claims, 2 Drawing Sheets

OTHER PUBLICATIONS

Products: Interfacings, Stonemountain & Daughter Fabrics, site illustrates the broad available to the consumer of fusible webs for sewing and crafts, viewed Feb. 25, 2009 at www.stonemountainfabric.com/pages/interfacings.html.*

Pellon Fusible Interfacing Products for Apparel and Crafts, article describing the general use of the fusible product for binding to fabrics, viewed Feb. 25, 2009 at www.pellonideas.com/content/view/22/27 © 2008 Pellon Consumer Products Group.*

* cited by examiner

PIANO HAMMER

BACKGROUND OF THE INVENTION

1. Field of the Invention

The present invention relates to an improved piano hammer of the type used in the mechanical action of any type of piano, be it a grand piano ("pianoforte") or an upright piano. More particularly, the invention relates to a novel covering on the striking surface of a piano hammer which results in improved tone quality, increased dynamic range and improved durability of the hammer.

2. Prior Art

One of the critical operating components of the mechanical action in a piano is the hammer that strikes the wire or wires of the piano string. Since the tone quality of each note in a piano is considerably and largely dependent upon the construction and density of the hammer, many attempts have been made to improve the hammer and especially its contact surface.

A piano hammer conventionally comprises an elongate "hammerhead", usually made of wood, having a nose portion that is usually wedge shaped. A felt covering surrounds the nose portion with tail portions affixed to the side surfaces of the nose portion, usually with glue and a reinforcing staple. Such felt covering defines a substantially elliptical peripheral surface which extends from the top of the hammer, in the region which strikes the piano string, away from this region through a widest point between the front and back of the hammer, hereinafter called the "equator" of the hammer, to the terminus of the tail portions. (It will be understood that the "top", "front" and "back" of the hammer refer to the respective sides of a hammer as installed in a grand piano. This terminology will be used herein although the hammer may be installed in an upright piano where the "top" becomes the "front" of the hammer and the "front" and "back" become the "bottom" and "top", respectively). Over time, the felt covering generally becomes worn and/or compressed and hardened at the top region under continuous use to such an extent as to impair the tone of the piano. Attempts have therefore been made to find a felt covering material which is highly resistant to wear and other damage.

The U.S. Pat. No. 3,487,429 to Johnson discloses a piano hammer having the felt covering forming the striking member comprised of a blend of wool fibers and thermoplastic fibers. This felt covering is said to be durable and can be formed with a "controlled density" for different registers of the piano.

The U.S. Pat. No. 4,135,430 to Hayashida discloses a simplified piano hammer comprising a wooden base, a striking head and an outer "protective covering" surrounding the end of the wooden base and covering the striking head. The striking head is a relatively thin strip made of elastic material such as polyurethane. The protective covering is made of a "protective material such as deer-skin or artificial leather".

The U.S. Pat. No. 5,125,310 to Lombino teaches a piano hammer comprising an elongate wooden head with a "nose portion" and a felt body extending about the nose portion. Tail portions of the felt body are affixed to the side surfaces of the nose portion. The felt body is comprised of an "outer felt" made of 100% wool and an "under felt". The patent is directed to a method of manufacturing wherein the sides of the outer felt are impregnated with an aqueous solution containing an acrylic copolymer.

SUMMARY OF THE INVENTION

A principal object of the present invention is to improve upon my earlier patent, U.S. Pat. No. 7,262,351, providing an improved piano hammer which is more durable and long lasting than piano hammers of the prior art while at the same time yielding improved tone quality and the increased dynamic range of the piano. The invention offers a relatively simple solution to many of the everyday headaches/concerns of pianists and piano owners while dramatically reducing the cost of maintenance year after year.

This object, as well as other objects which will become apparent from the discussion that follows, are achieved, in accordance with the present invention, by providing a conventional, felt-covered piano hammer with an elongated strip of material arranged on the peripheral surface of the felt covering, at least in the region thereof which strikes the piano string. This strip, which is sometimes referred to below as a "voicing tape, is composed of synthetic non-woven fabric material, preferably of the type sold under the registered trademark" Pellon, a material produced and sold by Freudenberg Nonwovens, LP, of Durham, N.C. It is formed of fine thermoplastic threads which are made into a non-woven cloth.

The voicing tape is made of (1) a single layer of thin, medium thin, or medium thick fabric; (2) a thinner second layer over the first; or (3) dual layered structure, ready-made. When two layers are used they are adhered together in a novel way to result in a composite dual layer strip or monolithic structure that is then applied to the piano hammer.

Preferably, the novel elongate strip extends from the top of the hammer, in the region for striking the piano string, downward and away from this region to the widest point, between the front and back of the hammer, herein called the "equator" of the hammer. The ends of the strip are attached to the felt covering by means of the heat fusible adhesive disposed on the end areas of the strip. Each of these adhesive areas extends from an end of the strip, at least for a short distance toward the center of the strip, the distance being approximately equal at least to the width of the strip.

When applied to the felt covering, the adhesive areas of the elongate strip are disposed between the equator of the hammer and the bottom terminus of the covering on either side, at the point where the wooden nose portion remains exposed. In the case of hammers that have a staple holding the felt covering in place, the elongate strip preferably extends a short distance beyond the staple, to cover the staple. Preferably, the width of the elongate strip is substantially equal to the width of the felt covering.

When positioned and attached in the manner described above, the elongated single or dual layer strip will be approximately four inches long for the largest hammer in the bass register of a piano, tapering or graduated downwardly to approximately two inches long for the smallest hammer in the treble register.

Pellon material is available on the market in many different grades of lightweight, medium and heavyweight thickness, and in hard and soft textures, some with heat fusible adhesive already coated on one side and some without. Preferably, a medium lightweight thickness, or a medium weight thickness, is used such that the approximate thickness of the elongate strip will be in the range of 0.015 inches to 0.025 inches when uncompressed, and in the range of 0.004 inches to 0.007 inches when compressed. Preferably also, a soft, a medium and/or smooth texture is used.

When iron fusible fabric having the adhesive coating evenly sprayed on one side is used, (so the entire length of the strip, not just the ends of the strip, is coated), the heat should be applied only over the ends of each strip. If the non-woven fabric one decides to use doesn't have the fusible adhesive coating, then iron fusible adhesive can be added to the ends of the strips (this should be done before the non-woven fabric is cut into strips) over a Teflon coated surface.

Regarding the description for approximately how long the voicing tape should be, it's only for esthetics that the staple is covered. The tape will work just as well when the staples are showing. The important point is that the strip is long enough so that the adhesive is not applied above the equator, the fattest portion of the hammer. In this way, the adhesive will have no effect on the tone quality.

Compared to gluing strips of non-woven fabric to the hammerheads, the process of iron-fusing the voicing tapes is much easier and faster (taking only a few seconds per hammer), and easier and neater when it has to be removed or replaced. In my prior patent (U.S. Pat. No. 7,262,351), I recommended using white glue, but this requires that it be taped down until the glue sets. The amount of glue is harder to control for unskilled hands, and the fabric tends to shift before the glue dries in humid weather. This is not ideal because the strips need to be reasonably tight around the hammerheads.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
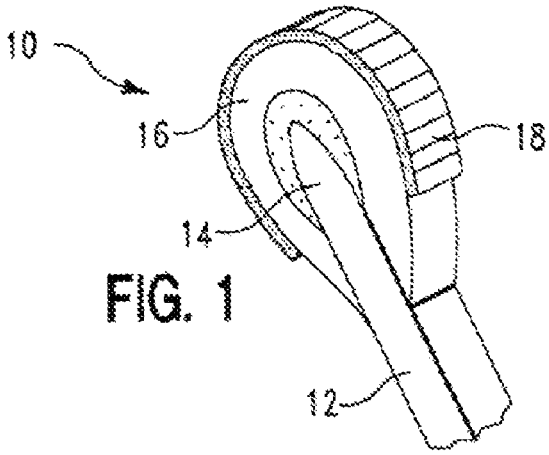
FIG. 1 is a perspective view of a prior art piano hammer upon which is applied a voicing tape according to an earlier one of my inventions.

The preferred embodiments of the present invention will now be described with reference to the FIGS. of the drawings. Identical elements are designated with the same reference numerals.

FIGS. 1 to 4 show my earlier invention as disclosed and claimed in my earlier patent, U.S. Pat. No. 7,262,351, the contents of which are here incorporated by reference in their entirety. As shown in FIG. 1 a conventional piano hammer 10 comprising an elongate, wooden hammerhead 12 having a nose portion 14 and a felt covering 16 affixed to the nose portion by means of an adhesive and a staple. The felt covering defines a substantially elliptical peripheral surface. As is well known, the top surface region of the felt covering of the piano hammer strikes the piano string (the piano wire or wires) and thus creates the musical tone.

An elongate strip or "voicing tape" 18 is arranged on the peripheral surface of the felt covering, at least in the region thereof which strikes the piano string. This strip is made of a synthetic non-woven material, preferably medium light-weight or medium weight Pellon, with a soft and smooth texture.

As may be seen in FIG. 1, the voicing tape is substantially equal in width to the width of the felt covering of the hammer.

According to my earlier invention, the voicing tape 18 is affixed to the felt covering by means of an adhesive applied on each end of the strip, preferably a white adhesive such as Elmer's white glue. Such glue is strong enough to hold the voicing tape, but allows the tape to be removed and replaced at a later date. No glue is applied between the tape and the felt covering of the hammer in the region near the top of the hammer which strikes the piano string.

Figure 2:
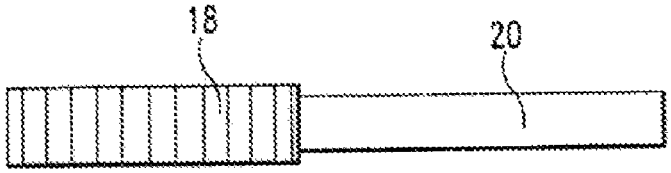
FIG. 2 is a top view of the prior art piano hammer with the voicing tape according to the earlier invention.
Figure 3:
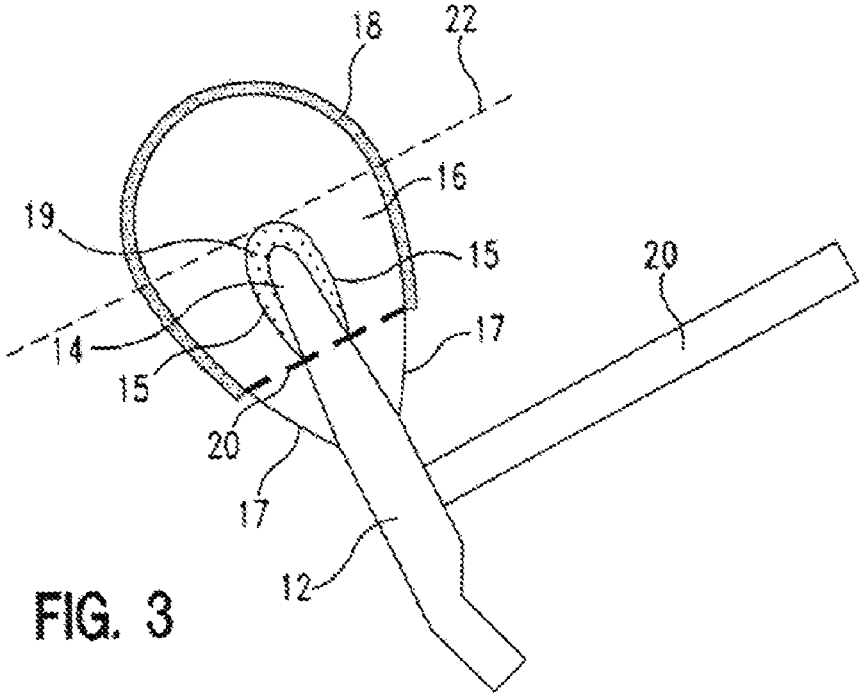
FIG. 3 is a side view of the prior art piano hammer according to the earlier invention.

FIGS. 2 and 3 illustrate the hammerhead of FIG. 1 in top view and side view, respectively. As best seen in FIG. 3, the nose portion 14 of the hammerhead 12, which is normally made of wood, has side surfaces 15. Tail portions 17 of the felt covering 16 are affixed to these side surfaces with an adhesive and, in most cases, by means of a staple 20. As shown by a dashed line in FIG. 3, this staple passes through the interior of the felt covering and the nose portion. Preferably, the region near the tail portions 17 of the felt covering 16 is impregnated with a hardening material such as an acrylic to improve its adhesion to the hammer 12 and to give the hammer extra support and power when played forte or fortissimo. The wooden hammerhead 12 is carried, in the mechanical action of the piano, by a wooden shank 20.

In the embodiment, shown in FIG. 3, the elongate strip or voicing tape 18 extends around the peripheral surface of the felt covering, from the front surface of the hammer to the back, covering the top region which strikes the piano string. It is preferable that the tape 18 extends beyond a line 22, at the "equator" of the hammer, which passes through the hammer at its widest point. It is also preferable that the adhesive between the tape and the felt covering be restricted to the area of the tape that extends "below" the equator, away from the region of the hammer that strikes the string. In this way only the felt covering and the voicing tape are involved in striking the string, so that the adhesive will not affect the tone of the piano.

For hammers in the bass register of a piano, the voicing tape 18 preferably extends downward slightly beyond the staple 20, thus covering the staple. In the mid range of the piano, the voicing tape may reach lower and lower on the hammers as they progress upward toward the treble. In the treble region the voicing tape may completely cover the periphery of the felt covering on the hammers.

Depending upon the size and shape of the hammers, the length of the elongate strip or voicing tape 18 is preferably in the range of approximately 9 to 10 cm (4 inches) for the No. 1 hammer, tapering to approximately 5 to 6 cm (2 inches) for the No. 88 hammer, with the lengths in between decreasing from hammer to hammer. The thickness of the elongate strip is preferably in the range of 0.015 inches to 0.025 inches when uncompressed or 0.004 inches to 0.007 inches when compressed.

Figure 4:
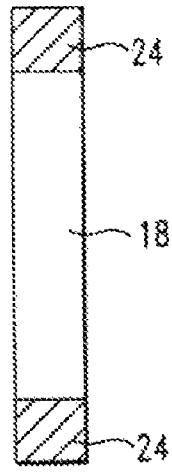
FIG. 4 is a plan view of the voicing tape according to the earlier invention.

FIG. 4 shows a voicing tape 18 in plan view. The areas 24 on which the adhesive is applied extend from each end of the tape for a distance toward the center of the tape which is approximately equal to the width of the tape.

The application of voicing tapes to the piano hammers can be done at any time during the life of a piano, whether the piano is new or old. In the case of an older piano, prior to applying a voicing tape to a hammer, the top region of the felt covering which strikes the piano string is filed smoothly, as necessary, and ironed to remove any grooves or the like which were made during previous use of the hammer. Thereafter, adhesive is applied to the voicing tape 18 to the areas 24 in FIG. 4 and the tape is wound tightly around the peripheral surface of the felt covering 16 of the hammer. It is held down with a short strip of tape, such as Scotch brand tape or masking tape, at each end until the adhesive, preferably Elmer's white glue, has fully cured. If the tone of the piano requires more muting, depending on the acoustics of the room and/or the musical taste of its owner, it is possible to add a second layer of voicing tape on top of the first. This layering of voicing tape is found to be preferable to using a single layer tape with a greater thickness.

It has been found that application of the elongate strip or "voicing tape" to a piano hammer makes the piano much quieter, with a −10 to −30 dB reduction in volume, while increasing the dynamic range from pppp to ffff, making the piano more responsive and sensitive to the touch of the player. While the voicing tapes may be applied to any piano, the resultant muting may not always be desirable or suitable for a piano in a large concert hall, noisy or outdoor environment.

In addition, application of the voicing tape to each of the hammers of a piano results immediately in an evenness of tone, eliminating the constant need for voicing. In effect, the tape provides a "permanent voicing" for the piano. Furthermore, the voicing tapes improve the tone quality of the piano, without need for replacing old or poor quality strings or hammers, and preserve the piano hammers for an extended period of time. The voicing tapes also make the sound of the piano more "pleasant", in spite of imperfections in the piano. In other words, this invention offers a practical and economical solution to multiple problems that artists face everyday (all their lives).

The improvement according to the present invention is not to use any glue. Instead, the fabric is iron- or heat-fused to the hammerhead. The voicing tape is preferably attached to the felt cover of the hammer by means of a heat fusible adhesive that is coated on one side of the tape. This makes the process of applying the tape much easier and faster (taking only a few seconds per hammer), and easier and neater when it has to be removed or replaced. My earlier invention used white glue, but this required that it be taped down until the glue sets. The amount of glue is harder to control for unskilled hands, and in humid weather the fabric tends to shift before the glue dries. This is not ideal because the voicing strips need to be reasonably tight around the hammerheads.

The voicing tape according to the present invention is made of (1) a single layer of thin, medium thin, or medium thick fabric; (2) a thinner second layer over the first; or (3) a dual layered structure, ready-made. The voicing tape is composed of synthetic non-woven fabric material, preferably of the type sold under the registered trademark "Pellon". If two layers are used, they are adhered together in a novel way to result in a composite dual layer strip or monolithic structure that is then applied to the piano hammer.

Figure 5:
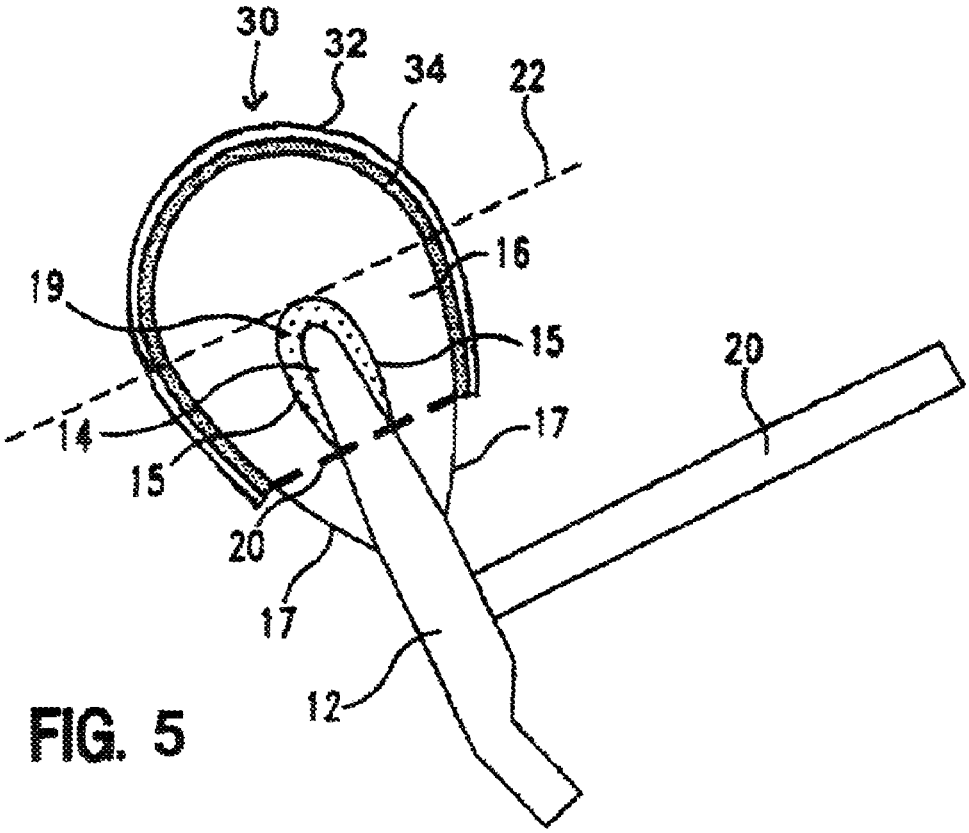
FIG. 5 is a perspective view of a novel piano hammer upon which is applied a novel composite voicing tape according to the present invention.
Figure 6:
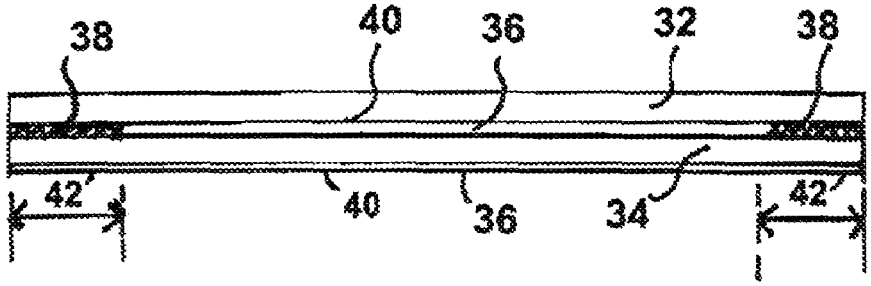
FIG. 6 is a side view of the novel composite voicing tape structure before it is applied to the piano hammer.

FIG. 5 shows a piano hammer with a novel voicing tape, indicated as 30. The voicing tape, as shown, consists of two layers of tape 32 and 34, each coated on one side with a hot iron-fusible coating. Although the voicing tape is shown as dual layer, a single layer of voicing tape can be used as noted above. The dual layer tape is shown in FIG. 6. The two layers 32 and 34 consist of a outer layer 32 of thinner and softer non-woven fabric over an inner layer 34 of thicker and stiffer type. Alternatively, one can use two layers 32 and 34 of medium soft non-woven fabric, and to treat the first layer 34 with synthetic hardener and then put the first layer 34 under the second layer 32, which is without treatment. Thus, the untreated second layer 32 is the exposed top layer.

Generally, double layer application gives the hammers extra durability and enables the player control over even wider ranges of tone colors and musical subtleties than the single layer application.

The softer and light to medium weight non-woven fabrics suitable for the voicing tape can be obtained from the company that makes Pellon (non-woven synthetic fabrics). As mentioned, these fabric strips are coated on one side with a heat fusible adhesive layer 36. The tapes 32 and 34, or layers, are put together one layer 32 on top the other layer 34 with the coated heat fusible adhesive layer 36 of the top tape or layer between the tapes 32 and 34. The coated heat fusible layer 36 will be exposed on the bottom surface of the underneath tape 34 as shown in FIG. 6. The end portions 42 of the tapes are sealed together at 38, as indicated by the hatching in FIG. 6 by using a Teflon surface as a support, so that the bottom coating 36 of the underneath layer 34 is unaffected. (Of course, this should be done before the fabric is cut into strips.) Then the combined or composite tapes or layers 32 and 34, with the center portions 40 of the tapes between the adhered ends 38 being free or not adhered together, are fastened to the felt covering 16 of the hammer by first heat sealing the end portion 42 of coating layer 36 on the underneath tape 34 to one end of the felt covering 16 and then heat sealing the other end 42 of the combined or composite tapes to the felt covering 16 while pulling tight to insure a good close fit onto the felt. When fixed on the felt covering 16, as described above, the portions 40 of the tapes 32 and 34 are free and not adhered together.

It requires the most sensitive and experienced ears to determine which method (single or double) and what thickness of fabric is best for a given situation. It has to be determined case by case, judging from the acoustics of the room, the needs and taste of the piano player, the level of their hearing, and the limitations of the instrument itself.

During the first 50 hours or so after the initial installation of voicing tapes, the voicing strips will get packed down as the piano is being played and the tone will somewhat brighten, giving an impression that the tape has lost about "⅓" of its muting effect. (in about 50 hours: an equivalent of at least 1000 fortissimo strikes per note). By applying a small amount of pure acetone over the voicing tapes, one can shorten this settling period to one tenth.

In the case of using a voicing tape composed of two layers, before affixing the second layer, the first layer should be treated by a small amount of hardener over the striking surface of each hammer. A lacquer-free acetone based hammer felt reinforcer, as sold by Schaff Piano Supply Co., further diluted with acetone (5 to 10 times) is suitable for this purpose and works well. The same solution can sometimes be used over the single layered voicing tapes, if the tone needs to be slightly brightened. In all cases, if all or some of the notes need to be a little softer, a gentle needling of the felt (a conventional voicing method) under the striking surface right through the voicing tape is allowed.

For these and other various reasons, the use of a single layer voicing tape is recommended for factory installations, and use of a thinner layer voicing tape over a thicker first layer voicing tape is safer than a ready-made dual layer structure for most applications. The ready-made dual layer structure is suitable for extra hard hammers, but should be used only by the truly experienced.

There has thus been shown and described a novel piano hammer which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a piano hammer comprising an elongate hammerhead having a nose portion defining side surfaces and a felt covering surrounding the nose portion with tail portions of the felt covering affixed to the side surfaces, said felt covering defining a substantially elliptical peripheral surface which extends from a top of the hammer, in a region for striking a piano string, away from this region through a widest point, between a front and a back of the hammer, called an "equator", to the terminus of said tail portions, the improvement comprising an elongate voicing tape arranged on the peripheral surface of the felt covering, heat fused only at its ends to the felt covering and extending from said region for striking a piano string along the front and back of the hammer to points beyond said equator, said voicing tape comprised of a synthetic, non-woven fabric material strip coated thinly and evenly on one side and only at the respective ends with a heat fusible adhesive and is resistant to wear and other damage and permanently re-voices the piano, when applied to all keys, making the piano quieter and extending its dynamic range.

2. The piano hammer defined in claim 1, wherein the width of said voicing tape is substantially equal to the width of said felt covering.

3. The piano hammer defined in claim 1, wherein said voicing tape has a soft and smooth texture.

4. The piano hammer defined in claim 1, wherein said felt covering is retained on said nose portion, at least in part, by means of a staple affixing said tail portions to said nose portion, and wherein said voicing tape extends on both the front and back of said hammer to a point near said staple.

5. The piano hammer defined in claim 4, wherein said voicing tape covers said staple on both the front and back of said hammer.

6. The piano hammer defined in claim 1, wherein the said voicing tape is one of single and dual layer.

7. The piano hammer defined in claim 6, wherein said dual layer voicing tape is comprised of one of a dual layer composed of a thinner second layer over a first layer, and a ready-made dual layered structure.

8. The piano hammer defined in claim 6, wherein said voicing tape is attached to said felt covering by means of a heat fusible adhesive disposed in an area adjacent only each end of said tape.

9. The piano hammer defined in claim 8, wherein said adhesive area extends from each end of said voicing tape to the other end of said tape, but is only heat fused at its ends to the felt covering.

10. The piano hammer defined in claim 1, wherein said synthetic, non-woven fabric material is a material sold under the registered trademark Pellon.

11. The piano hammer defined in claim 1, wherein the voicing tape uncompressed is from about 0.015 to about 0.025 inches in thickness and compressed is from about 0.004 to about 0.007 inches.

12. The piano hammer defined in claim 1, wherein the voicing tape is from about 2 to about 4 inches in length so that it can be heat fused to the hammer below the equator on both front and back of the hammer.

* * * * *